US006832917B1

(12) United States Patent
Neidich

(10) Patent No.: US 6,832,917 B1
(45) Date of Patent: Dec. 21, 2004

(54) INTERPOSER ASSEMBLY

(75) Inventor: Douglas A. Neidich, Harrisburg, PA (US)

(73) Assignee: InterCon Systems, Inc., Harrisburg, PA (US)

( * ) Notice: Subject to any disclaimer, the term of this patent is extended or adjusted under 35 U.S.C. 154(b) by 0 days.

(21) Appl. No.: 10/760,067

(22) Filed: Jan. 16, 2004

(51) Int. Cl.[7] ..... H01R 12/00
(52) U.S. Cl. ..... 439/66; 439/74
(58) Field of Search ..... 439/66, 65, 74, 439/91, 71, 591

(56) References Cited

U.S. PATENT DOCUMENTS

| | | | | |
|---|---|---|---|---|
| 3,289,452 | A | 12/1966 | Kollner | 72/324 |
| 4,998,885 | A | 3/1991 | Beaman | 439/66 |
| 5,049,084 | A | 9/1991 | Bakke | 439/66 |
| 5,123,848 | A | 6/1992 | August et al. | 439/66 |
| 5,248,262 | A | 9/1993 | Busacco et al. | 439/66 |
| 5,385,477 | A | 1/1995 | Vaynkof et al. | 439/66 |
| 5,400,222 | A | 3/1995 | Nelsen et al. | 361/804 |
| 5,403,194 | A | 4/1995 | Yamazaki | 439/66 |
| 5,531,022 | A | 7/1996 | Beaman et al. | 29/850 |
| 5,608,966 | A | 3/1997 | Donner et al. | 29/884 |
| 5,611,696 | A | 3/1997 | Donner et al. | 439/66 |
| 5,785,538 | A | 7/1998 | Beaman et al. | 439/91 |
| 6,019,610 | A | 2/2000 | Glatts | 439/66 |
| 6,046,911 | A | 4/2000 | Dranchak et al. | 361/784 |
| 6,062,879 | A | 5/2000 | Beaman et al. | 439/91 |
| 6,174,172 | B1 | 1/2001 | Kazama | 439/66 |
| 6,176,707 | B1 | 1/2001 | Neidich et al. | 439/66 |
| 6,217,342 | B1 | 4/2001 | Neidich et al. | 439/66 |
| 6,229,320 | B1 | 5/2001 | Haseyama et al. | 324/754 |
| 6,290,507 | B1 | 9/2001 | Neidich et al. | 439/66 |
| 6,315,576 | B1 | 11/2001 | Neidich | 439/66 |
| 6,350,132 | B1 | 2/2002 | Glatts | 439/66 |
| 6,528,984 | B2 | 3/2003 | Beaman et al. | 324/158.1 |
| 2002/0137365 | A1 | 9/2002 | McGrath et al. | 439/71 |

*Primary Examiner*—Hien Vu
*Assistant Examiner*—X. Chung-Trans
(74) *Attorney, Agent, or Firm*—Hooker & Habib, P.C.

(57) ABSTRACT

An interposer assembly includes a dielectric plate having a plurality of contact passages extending through the plate with a contact in each passage. Each contact is formed from a length of cylindrical preplated metal wire having a small diameter. Interposer assemblies with contacts formed from small diameter wire contacts have reduced contact inductance and permit reduction of the thickness of the dielectric plate and of the spacing between adjacent contacts on the plate.

30 Claims, 4 Drawing Sheets

INTERPOSER ASSEMBLY

FIELD OF THE INVENTION

The invention relates to interposer assemblies of the type which are sandwiched between substrates to form electrical connections between opposed pairs of pads on the substrates.

BACKGROUND OF THE INVENTION

U.S. Pat. No. 6,290,507, assigned to InterCon Systems, Inc. of Harrisburg, Pa., assignee of the present invention, discloses an interposer assembly including a dielectric plate with passages extending through the plate and metal spring contacts located in the passages for forming electrical connections between pads on opposed substrates. The contacts are stamped from thin strips of sheet metal, plated and then inserted into the passages to form electrical circuit paths extending through the thickness of the plate between pairs of contact pads. Plating of stamped contacts surrounds the contact with a protective plating to reduce contact resistance and prevent corrosion. The portions of the strip left over after stamping of the contacts are waste.

The contacts may be closely spaced from each other on the plate with X—X and Y—Y spacing of 0.050 inches (1 mm) using a plate having a thickness of 0.048 inches. This interposer assembly has a contact density of 400 to 645 contacts per square inch, depending upon the contact spacing. The contacts reliably establish electrical connections between pairs of contact pads when sandwiched between circuit members.

Interposer assemblies must meet performance standards for given applications, including size and inductance standards. Lower contact inductance permits the interposer assembly to transmit higher frequency signals between substrates.

Particular applications may require thinner plates and contacts spaced closer together than possible using an interposer assembly with spring contacts stamped from sheet metal. Applications using higher speed signals require that the contacts have less inductance than contacts stamped from sheet metal.

It is desirable to reduce the cost of an interposer assembly by reducing the thickness of the plate, the spacing between contacts and the size of the spring contacts in the passages extending through the plate.

Accordingly, there is a need for an improved interposer assembly with reduced plate thickness, more closely spaced spring contacts, less expensive spring contacts, and reduced contact inductance. The improved interposer assembly should be less expensive to manufacture than conventional interposer assemblies.

SUMMARY OF THE INVENTION

The invention is an improved interposer assembly with spring contacts mounted in passages extending through a dielectric plate where each contact is formed from a short length of small diameter preplated cylindrical wire. Each contact includes a rounded contact nose on each side of the plate for forming wiped high-pressure electrical connections with opposed contact pads.

The spring contacts are formed from preplated conductive wire preferably having a diameter of 0.004 to 0.005 inches. Contacts are cut from a continuous length of preplated wire without waste and are shaped immediately prior to insertion into the plate without the need to post-plate the contacts. The contacts are confined in passages in a thin plate having a thickness of as little as 0.025 to 0.035 inches with X—X and Y—Y spacing between adjacent contacts of 0.032 inches or less. The improved interposer assembly with wire spring contact spacing of 0.032 inches has a contact density of 1000 contacts per square inch. This contact density is considerably greater than the 400 to 645 contacts per square inch density of interposer assemblies using spring contacts stamped from sheet metal. The wire contacts reliably establish electrical connections with contacts or opposed substrates.

Miniaturization of the interposer assembly, elimination of waste and post-plating and insertion of spring contacts into through passages immediately after shaping reduces the cost of manufacture and assembly without sacrificing reliability.

Other objects and features of the invention will become apparent as the description proceeds, especially when taken in conjunction with the accompanying drawings illustrating the invention, of which there are four sheets of drawings and one embodiment.

DESCRIPTION OF THE PREFERRED EMBODIMENT

Figure 1:
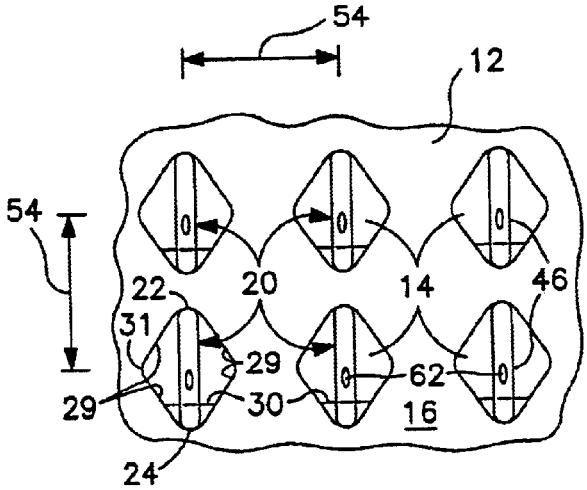
FIG. 1 is a top view, partially broken away, of an interposer assembly according to the invention.
Figure 3:
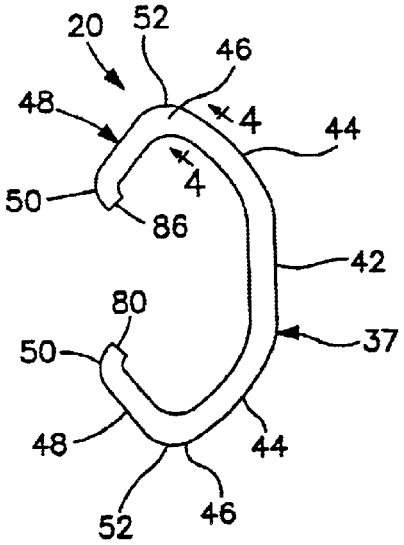
FIG. 3 is a side view of a contact used in the assembly of FIG. 1.

Interposer assembly 10 includes a flat dielectric plate or contact housing 12 preferably molded from thermoplastic resin and having a uniform thickness and a plurality of contact passages 14 extending through the thickness of the plate from plate top surface 16 to plate bottom surface 18. Passages 14 are arranged in closely spaced rows, as illustrated in FIG. 1. A metal spring contact 20 is held in each passage 14. The height or thickness of plate 12 may be as little as 0.025 to 0.035 inches.

Figure 4:
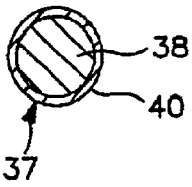
FIG. 4 is a sectional view taken along line 4—4 of FIG. 3.
Figure 2:
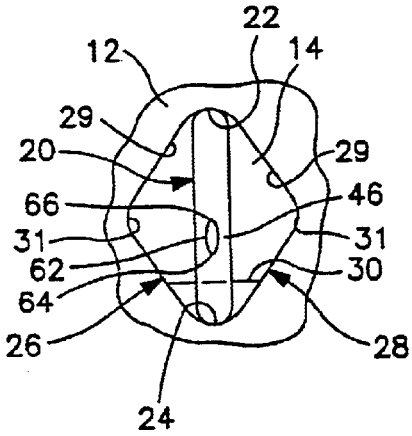
FIG. 2 is an enlarged view of a portion of FIG. 1.

Passages 14 have a rhombic transverse cross section illustrated in FIG. 2 with opposed end wall or groove 22 and projection end wall 24, and opposed, concave sidewalls 26 and 28 extending between the end walls. The sidewalls have generally flat sections 29 which diverge outwardly from end walls 22 and 24 to rounded central corners 31 so that passage 14 has a maximum width at corners 31, midway between the end walls.

Figure 8:
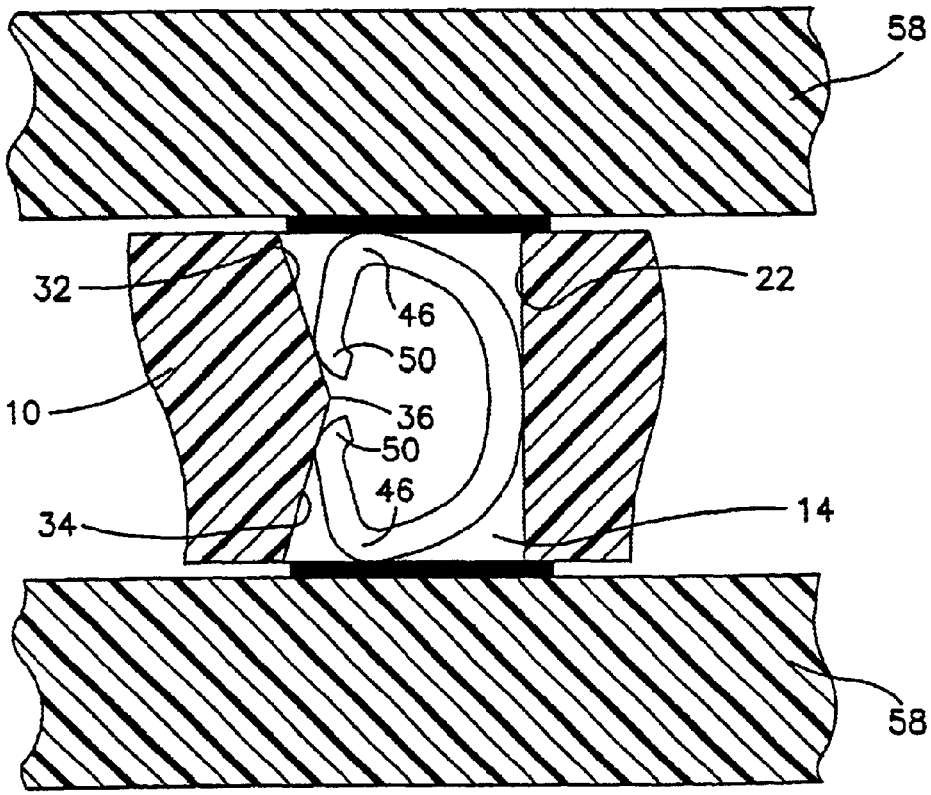
FIG. 8 is a view showing the contact compressed into the passage between opposed pads.

Groove 22 orients contact 20 vertically in a passage and permits bending movement of the contact from the groove when the contact is elastically stressed between pads, as shown in FIG. 8. Groove 22 need not be transversely curved as shown in FIG. 2. For instance, the groove may be formed by two converging sidewall sections 29 with the contact oriented between the sections.

Contact-retention projection 30 is formed in end wall 24 and extends into passage 14 across from end wall 22. The projection is defined by flat upper and lower cam surfaces 32 and 34 extending from projection tip 36 to the top and bottom surfaces of plate 12 respectively. The tip is located equidistant between the top and bottom of the plate. If desired, the projections may have a flat tip. Both cam surfaces slope away from the tip at a shallow angle of about 12 degrees from the vertical. Passage walls 22, 26 and 28 extend perpendicularly between the top and bottom surfaces 16 and 18 of plate 12.

Each contact 20 is formed from a short length or segment of cylindrical wire 37, preferably having a core 38 of high yield strength metal. The core 38 is surrounded by a cylindrical layer of conductive plating 40 to reduce contact resistance and prevent oxidation of the core. The core is preferably made from beryllium copper. The plating is preferably gold or a gold alloy. Contacts 20 may be made from preplated wire having a diameter of 0.004 to 0.005 inches. The contacts 20 have an essentially uniform, circular cross-section.

Each contact 20 includes a straight central portion or spine 42 and like upper and lower curved spring arms or beams 44. Arms 44 extend in opposite directions from spine 42. Like rounded contact noses 46 are located at the upper and lower ends of the spring arms. Like short, straight retention legs 48 extend from the noses away from spine 42 and toward each other to rounded ends 50. When contacts 20 are unstressed the noses 46 are spaced apart a distance greater than the thickness of plate 12. Contacts 20 are symmetrical to either side of the center of portion 42.

Spring contacts 20 are flat with the longitudinal axes of portions 42, 44, 46, 48 and 50 lying in a plane. The flat contacts fit in passages 14. Projections 30 retain the contacts in the passages. The contacts are held vertically in the passages by spines 42 which seat in vertical grooves 22. Grooves 22 are preferably slightly larger than the spines to assure the grooves orient the contacts vertically yet permit bending of the ends of the spring outwardly from the grooves as shown in FIG. 8.

Each contact nose 46 is convex with double curvature surface 52 facing away from plate 12. The longitudinal radius of curvature of surface 52, as measured along the length of the wire forming the nose, is greater than the transverse radius of curvature of the surface, the radius of the wire. For contact 20, the wire has a radius of 0.002 to 0.0025 inches.

Figure 9:
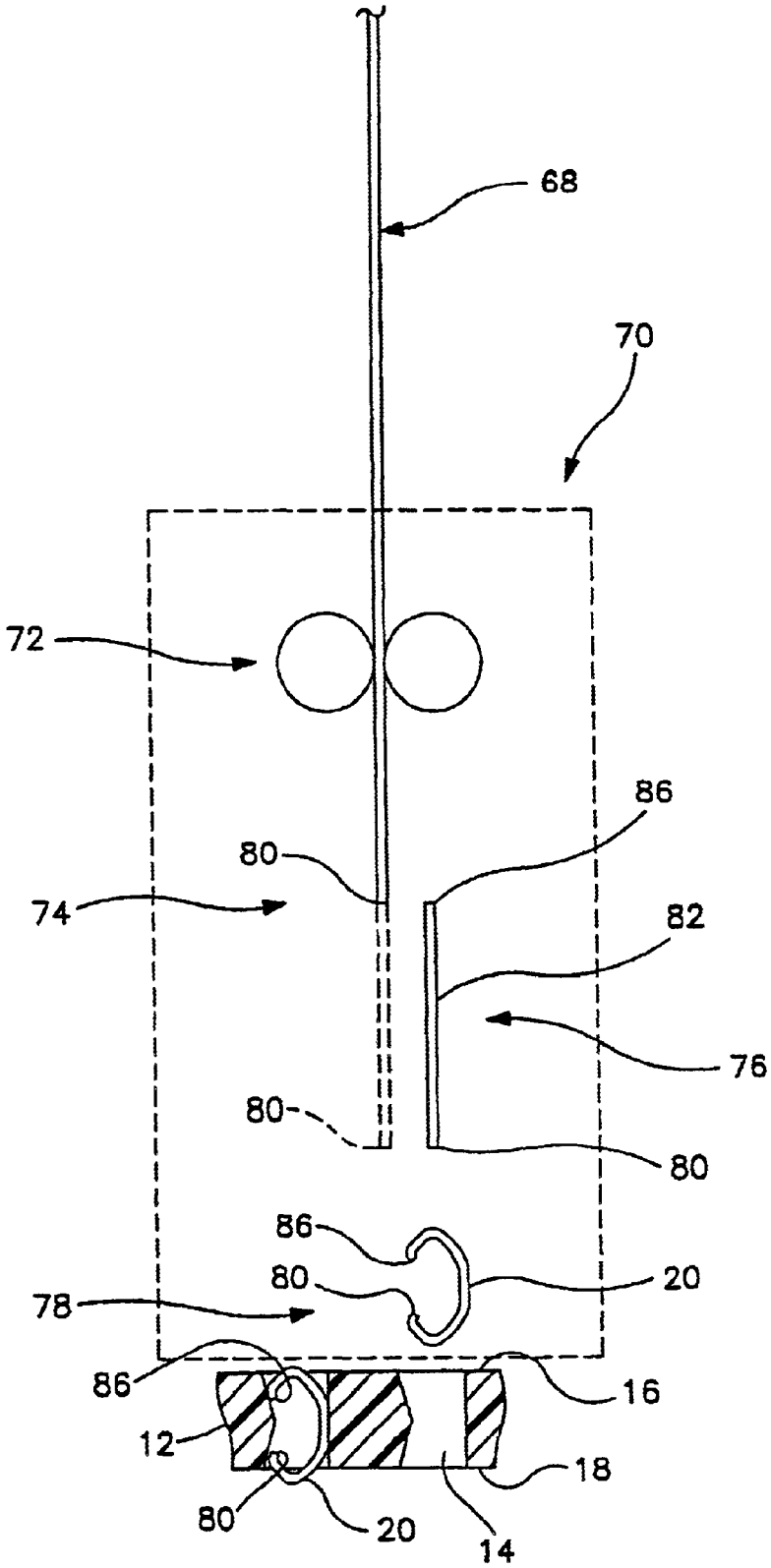
FIG. 9 is a representational view of contact form and insertion tooling.

The contacts 20 are formed from a continuous indefinite length of small diameter preplated wire 68 and inserted into cavities in plate 12 by contact form and insertion tooling 70 illustrated representationally in FIG. 9. The form and insertion tooling 70 includes wire feeder 72, wire cutter 74, contact former 76 and contact inserter 78. Contact inserter 78 is located adjacent one side of a plate 12 for positioning contacts 20 in passages 14.

The operation of tooling 70 will now be described. After formation and insertion of a prior contact, the wire feeder 72 is actuated to feed a length of wire 68 past cutter 74 and move the sheared lead end 80 of the wire to an extended position, shown in dotted lines, adjacent contact forming station 76. Cutter 74 is then actuated to cut extended wire segment 82 from wire 68 to form new lead end 80 of wire 68 and an associated trailing end 86 of wire segment 82. Segment 82 has a length sufficient to form a contact 20. Segment trailing end 86 and new wire leading end 80 are both formed when cutter 74 cuts the segment from wire 68. Segment leading end 80 and the trailing end 86 of the previous wire segment were formed when the cutter severed the previous wire segment from the wire. A leading wire end and a trailing wire end are formed each time a segment is cut from wire 68. The leading wire end and the trailing wire end formed when wire 68 is cut are "cut-associated," that is, both ends are formed simultaneously when the wire is cut.

After cutting of the wire to form segment 82, contact former 76 bends the segment to form contact 20, previously described. Protective plating 40 surrounds core 38 and extends the entire length of the wire segment and contact. Core 38 is exposed at ends 80 and 86 only.

Figure 5:
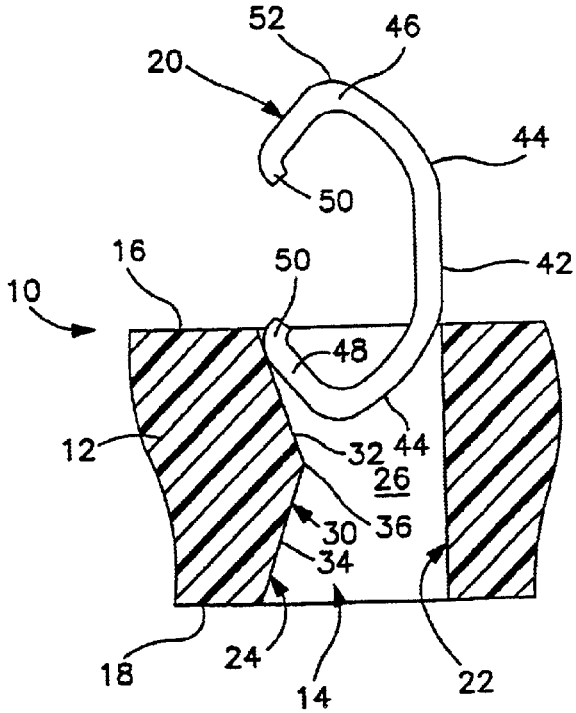
FIG. 5 is a sectional view taken through a passage in the assembly of FIG. 1 showing a contact in position to be inserted into the passage.

The tooling 70 and plate 12 are moved relatively to position the formed contact 20 to one side of an empty contact passage 14 with a contact nose located adjacent the center of the passage, spring arms 44 and spine 42 adjacent passage end wall 22 and retention legs 48 adjacent passage end wall 24. See FIGS. 5 and 9. Inserter 78 is actuated to insert the contact into the passage.

During insertion, converging sidewalls 26 and 28 at each end wall 22, 24 guide or funnel the flat contact into proper position in the passage. Spine 42 is moved down along end wall 22 in the groove. Lower retention leg 48 is moved into engagement with the adjacent cam surface 32. This engagement results because the horizontal distance between the spine and curved end 50 of leg 48 is greater than the minimum spacing between tip 36 and wall 22.

Figure 6:
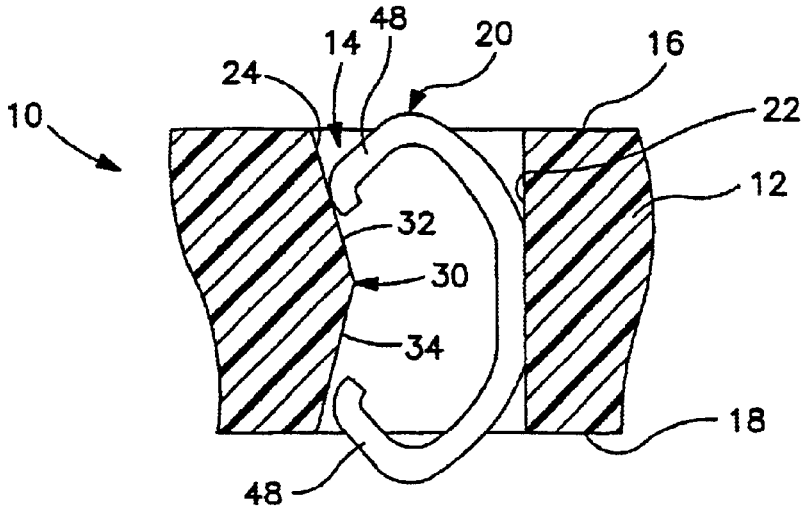
FIG. 6 is a sectional view like FIG. 5 showing the contact loosely confined in the passage.

Continued downward movement of the contact into the passage elastically stresses the contact to move leg 48 inwardly and past projection 36 to an inserted position shown in FIG. 6. After lower leg 48 passes the projection tip the contact returns to the shape shown in FIG. 6. The spine is seated in groove 22 so that the contact is vertical in the passage. In this position, the contact 20 is unstressed and loosely confined in passage 14. Projection 30 extends between the ends of the retention legs 48 to prevent dislodgement of the loose contact from the passage. Passages 14 hold contacts 20 in known positions on plate 12 with the noses 46 arraigned in a grid and spaced apart X—X and Y—Y distances 54 as small as 0.032 inches or less for establishing electrical connections with pads on upper and lower substrates.

FIG. 6 shows a loose contact 20 in passage 14. Gravity shifts the contact down in the passage so that the upper leg 48 rests on upper cam surface 32 and lower leg 48 is below the lower cam surface 34. With contact 20 in passage 14 as illustrated, the upper and lower contact noses 46 are located at the top and bottom surface of plate 12.

Tooling 70 efficiently forms the contacts and inserts the contacts into plate 12. Contacts are formed from wire segments and immediately inserted into passages 14 without waste. The ends 80, 86 of each wire segment 82 are cut-associated with corresponding ends of adjacent contacts in the plate. There is no need to plate the formed contacts prior to insertion into the plate. The plating 40 surrounds the surface of core 38 to assure the contact noses 46 and adjacent surfaces are plated.

When inserter 76 inserts contacts into passages 14 through top surface 16, the cut leading end 80 of each contact is adjacent plate bottom surface 18 and the cut trailing end 86 of each contact is adjacent plate top surface 16. The contacts may be inserted into the passages through bottom surface 18, in which case cut leading end 80 of each contact would be adjacent surface 16 and cut trailing end 86 would be adjacent surface 18.

Figure 7:
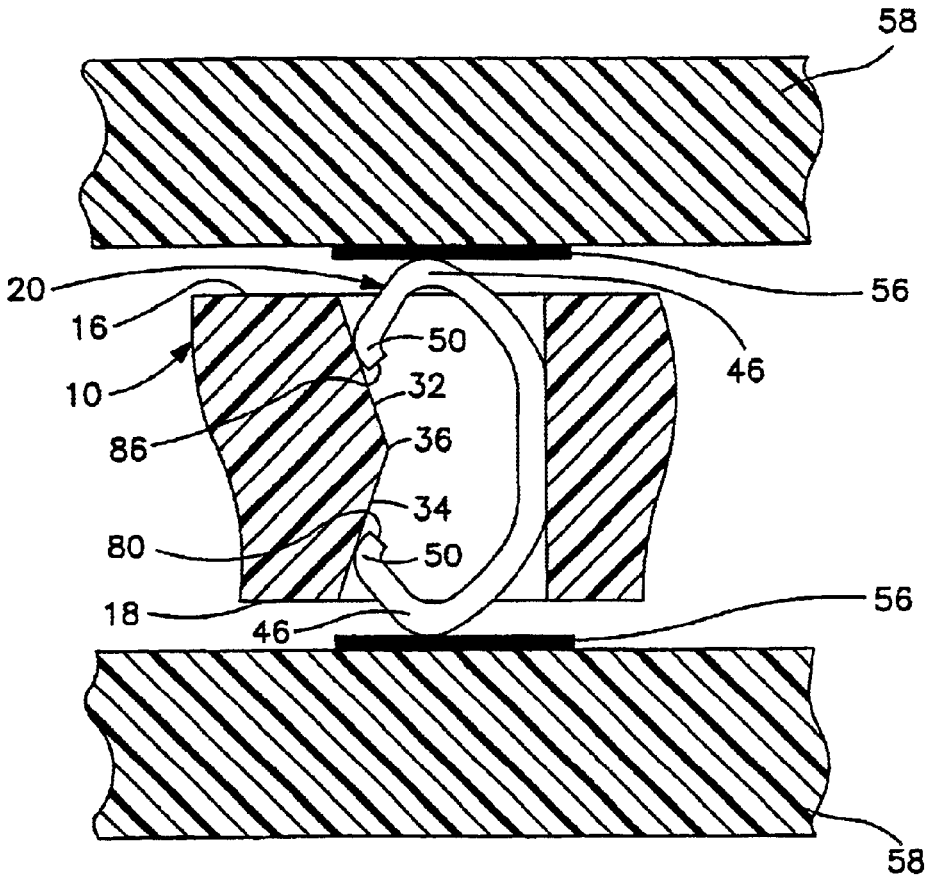
FIG. 7 is a view like FIG. 6 showing the contact in the passage between contact pads on overlying and underlying substrates.

Interposer assembly 10 establishes electrical connections between opposed contact pads 56 on substrates 58 located to either side of the assembly. FIG. 7 illustrates the interposer assembly 10 located between substrates 58 with the contact pads 56 lightly engaging the contact noses 46 and contact 20 lightly stressed. Contact ends 50 engage cam surfaces 32 and 34 and noses 46 extend above surfaces 16 and 18.

FIG. 8 illustrates interposer assembly 10 fully sandwiched between substrates 58 with the contact pads 56 on the substrates engaging the top and bottom plate surfaces and each contact 20 elastically collapsed into a passage 14. During movement of the substrates onto the plate each contact nose 46 is moved into the passage and the rounded ends 50 of the retention legs 48 slide inwardly along and up the cam surfaces 32 and 34 past the position of FIG. 7 to a fully compressed position shown in FIG. 8 where the ends 50 are adjacent tip 36. As the contact is collapsed, the retention legs 48, the spring arms 44 and the central portion 42 are bent elastically to provide high contact pressure between the contact noses and the pads 56 and to wipe the noses along the pads. The spring arms 44, noses 46 and legs 48 on each side of central portion or spine 42 form elastic spring systems.

During collapse of contact 20 each rounded end 50 is brought into contact with and slides up a portion of a cam surface 32, 34 spaced from tip 36 and spaced from the top and bottom surfaces 16 and 18. Compare FIGS. 7 and 8. Engagement of the contact ends with the cam surfaces away from the tips and away from surfaces 16 and 18 prevents a contact end 50 from hanging up on a tip or surface 16 or 18.

As contact 20 is collapsed into passage 14 contact noses 46 are held against the pads and are moved and rotated longitudinally along the pads toward end wall 24. Contact engagement between each contact nose and a pad occurs at a very small area surface 62 located at the outermost or top portion of surface 52 above the plate and extending longitudinally along the nose. The surface 62 rolls and wipes along the adjacent pad toward passage end wall 24 to form a small area and high-pressure clean, wiped electrical connection between the nose and pad. The plating 40 on the contact and the plating on the pad are soft and deform when the nose engages the pad to form surface 62 located at the center of nose 46.

The size of surface 62 has been exaggerated in FIGS. 1 and 2 for clarity. The pad first engages surface 62 at end 64. When contact 20 is fully compressed in passage 14 surface 62 engages the pad at end 66 and the remainder of surface 62 is spaced from the pad. The area of surface end 66 is very small, with a transverse dimension considerably less than the diameter of the wire forming nose 46. The shape of the smooth rounded contact noses, with a longitudional radius of curvature in the direction of wipe movement greater than the transverse radius of curvature, facilitates wipe movement between the contact and pad along surface 62.

The entire surface of wire contact 20 adjacent each contact surface 62 is plated to enhance conductivity and protect the wire contact from environmental corrosion. Corrosion at the point of connection with a pad could degrade the electrical connection. The unplated cut ends 80, 86 of contact core 38 are located in the center of passage 14 away from surfaces 62 and away from the electrical connections with the pads. The distance from the cut contact ends to the electrical connections between the noses and pads prevents corrosion occurring at a cut end from migrating to an electrical connection and degrading on connection.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention:

1. An interposer assembly comprising:

A) a plate formed from insulating material, the plate having a flat top surface, a flat bottom surface extending parallel to the top surface and a substantially uniform thickness;

B) a contact passage extending generally perpendicularly through the thickness of the plate from the top surface to the bottom surface; and a projection located in the passage, the projection extending outwardly from one side of said passage toward an opposing side of the passage, the projection having a first cam surface facing the plate top surface and a second cam surface facing the plate bottom surface; and C) a metal spring contact located in the contact passage, the contact formed from a wire having a metal core and a circumferential overplating of conductive metal surrounding the core and extending the length of the wire, the wire having a uniform circular transverse cross section; said contact having a central portion, a pair of spring arms extending to either side of the central portion, a pair of contact noses, each contact nose at an end of a spring arm, and a pair of retention legs, each retention leg extending from a contact nose to a rounded end, each contact nose between a spring arm and a retention leg, each contact nose having a convex surface facing outwardly from the plate and defining a high point, and a contact surface on each contact nose high point, each contact surface extending longitudinally along the nose and located centrally between the sides of the wire at the nose, the contact located in the passage with the central portion adjacent to said opposing side of the passage and the retention legs located on opposite sides of the projection so that the projection retains the contact in the passage.

2. The interposer assembly as in claim 1 wherein said contact includes unplated cut ends, said ends located adjacent said cam surfaces and away from the contact noses to prevent corrosion at such ends from impairing an electrical connection between the contact and a contact pad.

3. The interposer assembly as in claim 1 wherein said contact is flat.

4. The interposer assembly as in claim 1 wherein said contact is loosely confined in the passage.

5. The interposer assembly as in claim 1 wherein said wire has a diameter of about 0.004 to 0.005 inches.

6. The interposer assembly as in claim 5 wherein the plate has thickness of about 0.025 to 0.035 inches.

7. The interposer assembly as in claim 1 including a vertical groove in the opposing side of the passage, and wherein said contact central portion is seated in said groove.

8. The interposer assembly as in claim 7 wherein the passage includes two opposed sidewalls, each sidewall extending between the projection and the groove, each sidewall including a corner, said passage having a generally rhombic transverse cross section.

9. The interposer assembly as in claim 1 wherein said core is formed from a high yield strength metal and said plating is formed from gold or a gold alloy.

10. The interposer assembly as in claim 9 wherein said core is formed from beryllium copper and said plating is formed from gold or a gold alloy.

11. The interposer assembly as in claim 1 wherein said plate includes first means located in the passage for orienting the contact central portion relative to said bottom and top surfaces of the plate.

12. The interposer assembly as in claim 11 wherein said means comprises a pair of surfaces, said surfaces located on said opposing side of the passage.

13. The interposer assembly as in claim 11 wherein said means comprises a groove extending generally perpendicularly to said bottom and top surfaces.

14. The interposer assembly as in claim 11 including second means for guiding said contact central portion to said first means.

15. The interposer assembly as in claim 14 wherein said second means comprises two opposed walls in said passage.

16. The interposer assembly comprising:

A) a plate formed from insulating material, the plate having a flat top surface and a flat bottom surface;

B) a plurality of through passages extending through the thickness of the plate from the top surface to the bottom surface;

C) a projection located in the center of each passage, each projection extending outwardly from one side of a passage toward an opposing side of the passage;

D) a plurality of metal spring contacts, each contact in a passage, each contact formed from a length of wire having a generally uniform circular cross section and including a metal core, a metal plating surrounding the core and ends exposing the core;

E) each contact having a central portion, a pair of arms extending to either side of the central portion, a contact nose at the end of each arm, and a leg extending from each nose, each nose having a high point;

F) the projection in each passage extending between portions of the contact in the passage to retain the contact in the passage;

G) the contact noses each having a transverse radius of curvature equal to the radius of the wire and a longitudinal radius of curvature greater than the transverse radius of curvature of the wire, and a longitudinally extending contact surface at the high point of each nose, each contact surface located centrally between the sides of the wire.

17. The interposer assembly as in claim 16 wherein each contact includes a cut leading end and a cut trailing end, the cut leading end of each contact located adjacent one side of the plate and the cut trailing end of each contact located adjacent the other side of the plate.

18. The interposer assembly as in claim 16 wherein said wire includes a beryllium copper core and gold or gold alloy plating surrounding the core.

19. The interposer assembly as in claim 16 wherein said plate has a thickness of about 0.025 to 0.035 inches.

20. The interposer assembly as in claim 16 wherein said contacts are flat.

21. The interposer assembly as in claim 16 wherein said contacts are loosely confined in the passages.

22. The interpose assembly as in claim 16 wherein said plurality of contacts include first, second and third contacts each having two cut ends; one cut end of said first contact cut-associated with a cut end of the second contact and the other cut end of said first contact cut-associated with a cut end of the third contact.

23. The interposer assembly as in claim 22 wherein each pair of cut-associated cut ends includes a cut end adjacent one plate surface and a cut end adjacent the other plate surface.

24. The interposer assembly as in claim 16 wherein said wire has a diameter of about 0.004 to 0.005 inches.

25. The interposer assembly as in claim 24 wherein said contacts are located in rows spaced apart about 0.032 inches or less.

26. The method of forming and loading metal spring contacts in an insulating plate, the method comprising the steps of:

A) providing an insulation plate having a plurality of passages extending through the thickness of the plate;

B) providing an indefinite length of contact wire having a core and a plating surrounding the core;

C) cutting successive wire segments from one end of the contact wire without waste so that each segment includes a cut lead end and a cut trailing end;

D) bending each cut wire segment to form a spring contact; and

E) inserting each formed spring contact into a passage in the plate.

27. The method of claim 26 including the step of:

F) bending and inserting each wire segment before cutting the next wire segment from the wire.

28. The method of claim 26 including the step of:

F) bending said wire segments so that each contact includes two contact noses spaced apart a distance greater than the thickness of the plate and the cut lead end and cut trailing end of the contact are away from such noses.

29. The method of claim 26 including the step of:

loosely confining the contacts in the passages.

30. The method of claim 26 including the step of:

bending said wire segments to form flat spring contacts.

* * * * *